US007182704B2

(12) United States Patent
Levy

(10) Patent No.: US 7,182,704 B2
(45) Date of Patent: Feb. 27, 2007

(54) AUTOMATED BALL GAME TRAINING AND PLAYING SYSTEM

(76) Inventor: Avery Levy, 12 Pheesants Run, Harrison, NY (US) 10528

( * ) Notice: Subject to any disclaimer, the term of this patent is extended or adjusted under 35 U.S.C. 154(b) by 140 days.

(21) Appl. No.: 10/733,715

(22) Filed: Dec. 10, 2003

(65) Prior Publication Data

US 2005/0130772 A1 Jun. 16, 2005

(51) Int. Cl.

| | |
|---|---|
| ***A63B 67/00*** | (2006.01) |
| ***A63B 69/00*** | (2006.01) |
| *A63B 61/00* | (2006.01) |
| *A63B 5/11* | (2006.01) |

(52) U.S. Cl. ..... 473/415; 473/433; 473/472; 473/465; 473/490; 273/317.3; 434/248; 434/247; 482/27; 482/30

(58) Field of Classification Search ..... 482/27, 482/30; 273/317.3, 397; 473/469, 465, 473/471, 415, 472, 490, 447

See application file for complete search history.

(56) References Cited

U.S. PATENT DOCUMENTS

| | | | | |
|---|---|---|---|---|
| 3,201,126 | A | 8/1965 | Nissen | |
| 3,233,895 | A * | 2/1966 | Grelle et al. | 482/27 |
| 3,312,471 | A * | 4/1967 | Nissen | 473/469 |
| 3,339,925 | A * | 9/1967 | Nissen | 473/469 |
| 4,013,292 | A | 3/1977 | Cohen et al. | |
| 4,162,063 | A * | 7/1979 | Nissen et al. | 482/27 |
| 4,239,214 | A | 12/1980 | Brenner | |
| 4,452,444 | A * | 6/1984 | Schulze, Jr. | 482/27 |
| 4,699,386 | A | 10/1987 | Carzino | |
| 5,064,195 | A | 11/1991 | McMahan et al. | |
| 5,138,322 | A | 8/1992 | Nuttall | |
| 5,330,175 | A * | 7/1994 | Kim | 273/397 |
| 5,364,091 | A | 11/1994 | Sebek | |
| 5,370,591 | A * | 12/1994 | Jewell et al. | 482/30 |
| 5,537,212 | A | 7/1996 | Kelly et al. | |
| 5,624,122 | A * | 4/1997 | Winkelhorn | 473/471 |
| 5,684,453 | A | 11/1997 | Welch | |
| 5,697,791 | A * | 12/1997 | Nashner et al. | 434/247 |
| 5,776,018 | A | 7/1998 | Simpson et al. | |
| 5,833,557 | A | 11/1998 | Cole | |
| 5,842,699 | A * | 12/1998 | Mirando et al. | 273/317.3 |
| 5,984,684 | A * | 11/1999 | Brostedt et al. | 434/252 |
| 6,042,490 | A * | 3/2000 | Lenhart | 473/415 |
| 6,095,928 | A | 8/2000 | Goszyk | |
| 6,133,946 | A | 10/2000 | Cavallaro et al. | |
| 6,280,352 | B1 | 8/2001 | Coffeen et al. | |
| 6,389,368 | B1 | 5/2002 | Hampton | |
| 6,488,600 | B1 * | 12/2002 | Gordon | 473/490 |
| 6,634,966 | B2 * | 10/2003 | Gordon | 473/415 |
| 6,676,546 | B2 * | 1/2004 | Gordon | 473/490 |
| 6,682,444 | B2 * | 1/2004 | Gordon | 473/415 |

* cited by examiner

*Primary Examiner*—Mitra Aryanpour
(74) *Attorney, Agent, or Firm*—Burns & Levinson LLP; Jacob N. Erlich

(57) ABSTRACT

A ball game system for training and/or play comprising a one or more playing areas suitably large to accommodate running and jumping players, each playing area including adjacent surface areas forming a court and having distinctly different properties, such as a first surface suitable for bouncing a ball and a second surface comprised of a deformable elastic material. The system includes an automatic ball feeder and sensors for monitoring the positions and trajectories of one or more players and/or balls on the court. Options include visual displays and/or audio outputs reflective of player performance, and payment-driven operation of the system components, including a means for adjusting the degree of rebound provided by the deformable elastic surface(s).

32 Claims, 9 Drawing Sheets

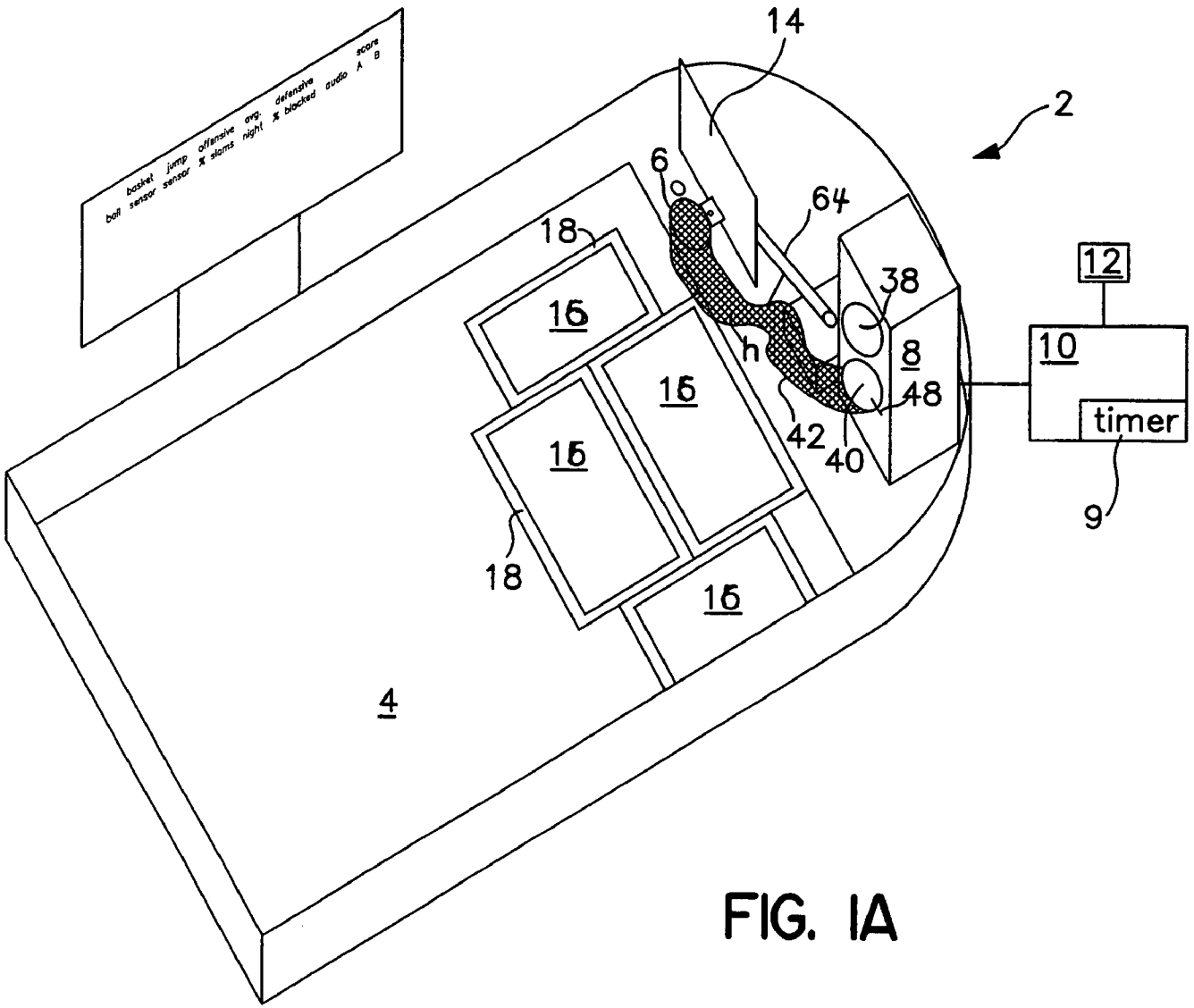
FIG. IA

AUTOMATED BALL GAME TRAINING AND PLAYING SYSTEM

FIELD OF THE INVENTION

The present invention relates to ball games and game courts for ball games involving running and jumping, and more particularly to court systems for use in practice and/or training for and playing such games thereupon with aid of objective measurements of player performance during such training and/or playing.

BACKGROUND OF THE INVENTION

The sport of basketball has been known and popular for many years. Various embodiments of the game have been developed using different numbers of players. Similarly, elastic surfaces or trampolines have been a source of entertainment for over 70 years. Among the joys of playing basketball is the ability to dribble, jump high and dunk or slam a ball into the basket. The recently developed game of SLAMBALL™ combines many of these skills.

Basketball and SLAMBALL™ have captured the interest of spectators and players of varying levels of skill, from beginner to competitive professionals. Any person desiring to develop the skills required of either game may have a difficult time doing so alone. Finding an available court is sometimes challenging for basketball players, but it is especially challenging for SLAMBALL™ players, who must find a court having a combination of rigid and elastic surfaces that will accommodate practice, training and/or play. Players improve through repeated practice and by receiving instruction from others more knowledgeable than themselves, and in particular by receiving feedback regarding their own performance through criticism and/or objective measurements.

Ball game players often find that they do not receive sufficient shooting or slamming practice during normal team practices. Thus, there is a continuing need for persons desiring to improve their skills to practice independently and in a time-efficient manner, where a great deal of time is not lost chasing after loose balls rather than shooting or slamming. Several types of basketball retrieval apparatuses that automatically return a ball to a player are known in the art, but none address the court availability or performance improvement quantification problems, i.e. they do not address the need to objectively measure performance during either a practice session or an actual game. There are player skill parameters, referred to herein as "metrics", for which traditional means for measuring performance (e.g., a stopwatch) are insufficient. In the games of basketball and SLAMBALL™, these include measures of the vertical heights from a playing surface that a player attains, as well as statistics related to successful and unsuccessful slam-dunks. Means for quantifying such skills in the context of a practice session or an actual game would be highly desirable.

There is also a need for those players desiring training and instruction to receive it in a cost-efficient manner. A system allowing either individualized or group on-court instruction would be highly advantageous.

SUMMARY OF THE INVENTION

The objects set forth above as well as further and other objects and advantages of the present invention are achieved by the embodiments of the invention described hereinbelow.

The present invention provides a basketball and/or SLAMBALL™ court system enabling practice and skills development. The court system may be used by a single player or multiple players on the same court, or in alternative embodiments, one or more players on one court may compete against one or more players on a different court.

In preferred embodiments, the system includes at least one SLAMBALL™ court equipped with automated components facilitating practice and play. Operation of the automated components is controlled by a central computer, typically in response to a payment received from the player (s) wishing to use the facility. The system can be used for leisure or as an entertainment attraction similar to baseball/softball batting cages and soccer kicking cages. Several embodiments of the invention include sensors for measuring the athletic performance and/or skill level of the player or players on the court. Such performance information ("metrics") can serve a multitude of purposes. A single individual may wish to assess his or her own performance objectively, for example, to compete against themselves. The metrics may also be used to individualize training to be provided, or to compete against other players' performances.

Game courts may also be used by competing teams of offensive and defensive players on the same court, or by competing teams on different courts (i.e., in multi-court embodiments.) For example, two teams simultaneously competing against one another with appropriate offensive and defensive metrics can also use a two-court embodiment. Any number of courts can be included in the system, in configurations of competition and practice as desired. In practice mode, an automatic ball feeder delivers a basketball to a player at a selected speed and trajectory to a desired point.

In a basic form, the system includes a playing area including a planar playing surface (such as a basketball or SLAMBALL™ court), a hoop above the playing surface through which players attempt to shoot or slam a ball, and an automatic ball feeder that only delivers balls if the player(s) has paid for the privilege of using the court. The ball feeder operation is controlled through a mechanism, which is preferably but not necessarily a computer, that receives an indication from a payment receiving means of whether sufficient payment has been received. Payments may be made in any payment form, such as tokens, credits, cash, credit cards and arcade-type cards, and can entitle players to a certain amount of system use time, a certain number of delivered balls (determined by a ball counter), or any other predetermined measure of system usage. It is preferred to have some type of sectioning means surrounding the playing area for preventing loose balls from traveling too far, perhaps into adjacent playing areas.

The playing surface may comprise a typical basketball (parquet) floor, or alternatively a resilient surface adjacent one or more deformable elastic surfaces, such as trampolines that are well known in the art. Trampoline construction is well known, involving a sturdy membrane or fabric suspended by a plurality of coil springs each attached to the fabric on one end and to a stationary element on their respective other ends. A detailed description of SLAMBALL™ court surfaces may be found in U.S. Patent Application Publication No. 2003/0013560. Artisans will appreciate that other materials may be used in the construction of the deformable surfaces while remaining within the scope and intent of the invention. For the protection of leaping players, it is preferred to dispose a layer of padding about the perimeter of the deformable surfaces, i.e. at the interfaces of the resilient and deformable surfaces. The deformable surfaces can exhibit a variety or uniformity of shapes, such as squares, rectangles, triangles, circles, ellipsoids, trapezoids, hexagons, and octagons.

In an alternative embodiment, player use of the system can be limited by a means for adjusting the elasticity of rebounds provided by the one or more deformable elastic surfaces. A number of means will be described in detail below with reference to the figures of the drawing. Several such means rely on the use of hydraulic pistons to counter the elastic forces provided by component springs of the trampoline that give the trampoline its 'bounciness'. Another approach involves pressurizing one or more chambers below the deformable surface to greater than atmospheric pressures, thereby reducing the extent of deformation possible of the deformable surfaces.

A non-obtrusive ball collector is preferably deployed below the hoop for conveying balls passing through the hoop to the ball feeder. In a preferred embodiment, the ball collector comprises netting sleeve disposed circumferentially below the hoop and forming a channel of sufficient diameter to accommodate the balls passing through the hoop. Other ball collectors, such as sheets of flexible polymeric materials similarly dimensioned and positioned could equally be used. One or more sensors disposed at the hoop and/or ball feeder indicates whether a shot or slam has been successful, i.e. by sensing whether a ball has passed through the hoop.

In yet another embodiment, a plurality of sensors outputs to the computer position and trajectory information related to the one or more players and the ball(s) on a court. The computer accepts this sensor information, and from it creates an output indicative of the movement of the one or more players and ball. The output can be visual, such as the display of player metrics, time, score, distance or angle from the hoop, etc . . . , and/or audio, such as simulated crowd noise or training instruction to a player in response to his or her measured athletic performance. The computer and sensors have the ability to differentiate between various players on a court, and can determine whether shot and/or slam attempts have been successful, or perhaps missed or blocked. Player metrics are directly related to the skill level of a player, and can include a variety of parameters, such as vertical height(s) jumped, percentage of successful shots or slams or blocks, overall number of successful shots or slams, number of jumps, average jump height, hang time, score, and others. These may optionally be represented as a function of time, deformable surface elasticity, hoop height, etc. The sensors may also be useful in determining whether players adhere to particular game rules. For example, in the game "around the world", players shoot balls at the hoop from predetermined, progressive positions (such as, for example, those indicated by reference numerals 53 in FIG. 4) around the playing surface—the sensors will be able to determine whether the player has made the shot from the appropriate position.

In addition to controlling, in alternate embodiments, adjustable position of hoop and/or backboard, the ball feeder, elasticity adjusting means, sensors and output devices, the control mechanism may optionally control a camera for recording, in still photos or on videotape, a practice session or game played.

As mentioned above, the invention provides several configurations including multiple playing areas, which may be used independently or in combinations for competition. The multiple playing areas are, in some configurations, defined by a large single playing surface having multiple courts separated from one another by a sectioning means. The sectioning means may comprise a net, wall or some other type of divider that separates players and prevents loose balls from traveling to other courts, or alternatively the sectioning means may comprise a simple marking on the surface that does not present a physical impediment to players who wish to play a "full court" version of basketball or SLAMBALL™.

Distinct playing areas may each be equipped with independent ball capture and ball feeder mechanisms, but in one preferred form of the invention the playing areas are located around a single, central ball feeder responsible for delivering balls to all of the playing areas.

BRIEF DESCRIPTION OF THE FIGURES OF THE DRAWINGS

For a better understanding of the present invention, together with other and further objects thereof, reference is made to the accompanying drawing and detailed description, wherein.

DETAILED DESCRIPTION OF CERTAIN PREFERRED EMBODIMENTS OF THE INVENTION

Figure 1B:
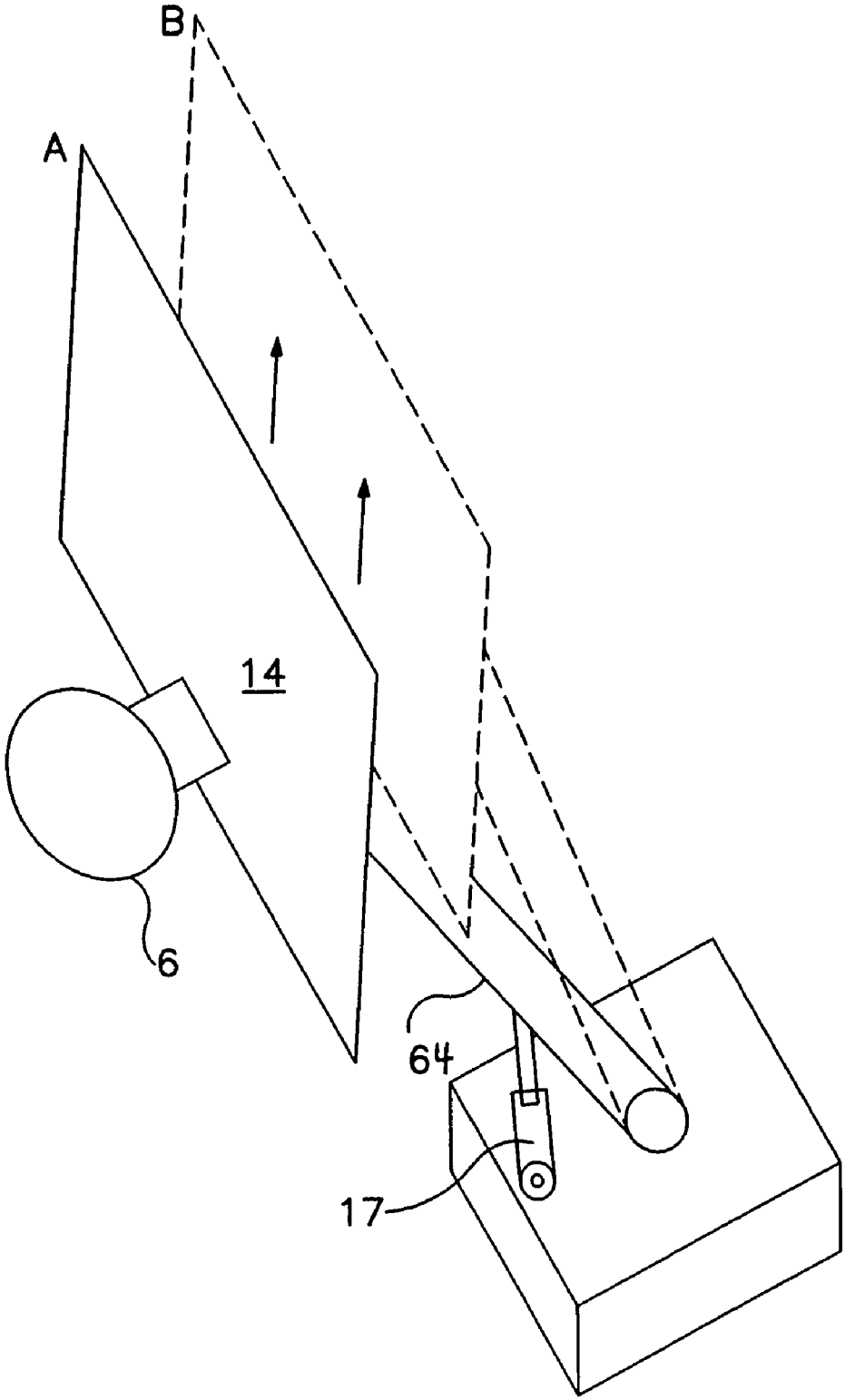
FIGS. 1B,C are schematic illustrations of support mechanisms that allow repositioning of a hoop and backboard used in the system.

The present invention provides a system of one or more automated game courts, such as basketball or SLAMBALL™ courts, upon which one or more players can play or practice to improve their skills.

With reference to FIG. 1A, one preferred embodiment of a preferred ball game system 2 is comprised of a planar playing surface (or court) 4 of approximately basketball-court dimensions, a hoop 6 shaped to receive a ball such as a basketball positioned at one of the court 4, an automated ball feeder 8, the operation of which is controlled by a control mechanism or computer 10 in response to a signal from a means for receiving a payment 12.

Figure 1C:
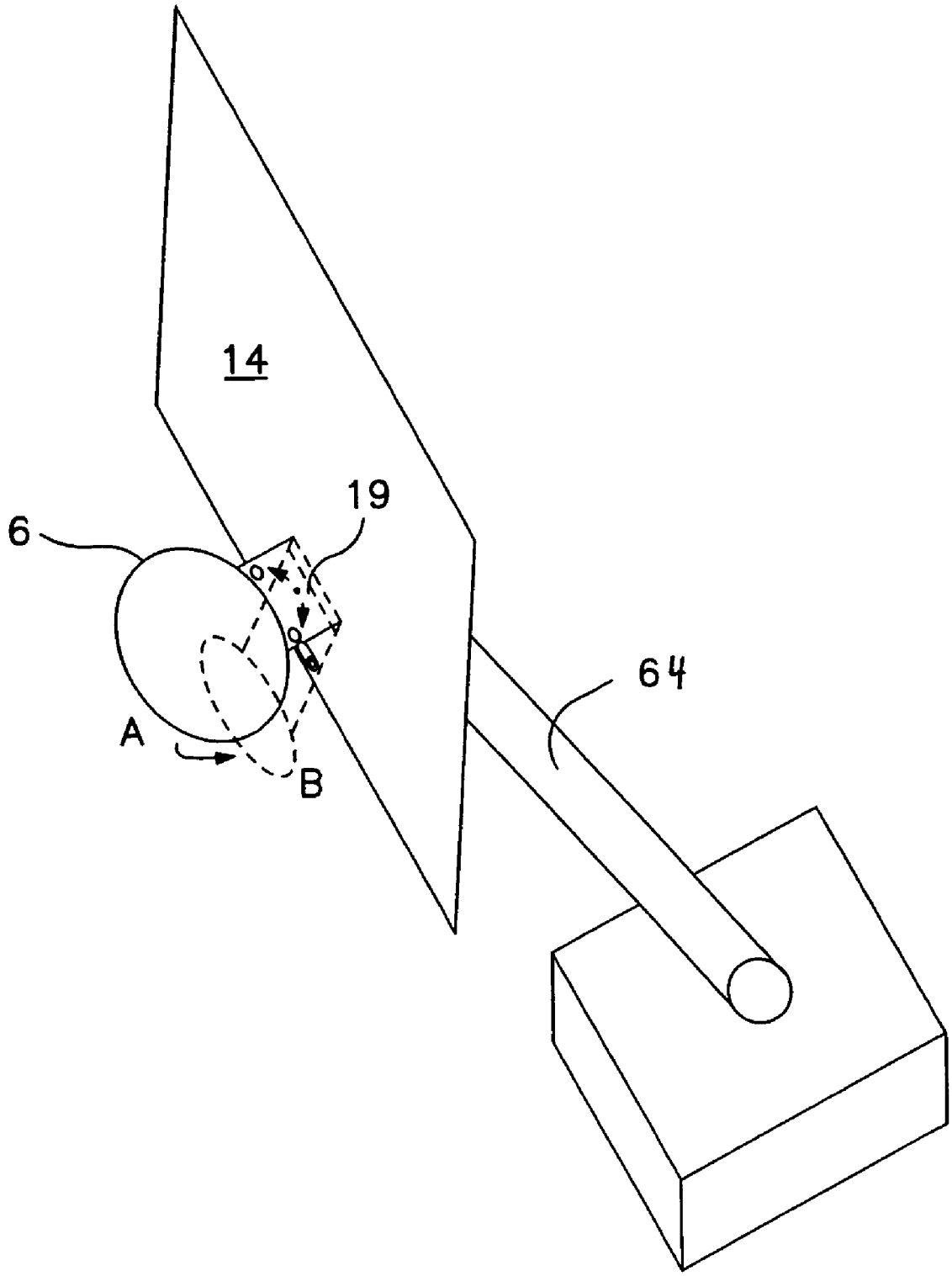
FIG. 1A is a schematic representation of a single court embodiment of an automated system in accordance with the present invention.

Hoop 6 is located at an elevated position above the court 4, and is typically accompanied by a backboard 14. With reference to FIG. 1B, the hoop and backboard are shown supported by a stand 64, which is preferably adjustable (from position A to position B) in order to vary the vertical height of the hoop in order to make passing, dunking or 'slamming' a ball through the hoop more or less difficult. This could be accomplished through use of a hydraulic piston 17. Note that although all support means for the hoop and backboard illustrated and described are floor-mounted, the invention is not so limited—support and adjustment means could easily be ceiling-mounted. The vertical hoop height of a player's slam may be a factor in assessing the player's performance in a practice session or game. In certain configurations, reflected in FIG. 1C, hoop 6 is optionally adjustable from a horizontal position A to a vertical position B in order to prevent use of the system beyond the allotted time. In such systems, hoop 6 is hingeably connected to backboard 14 and one or more hydraulic pistons 19 operate to reposition the hoop 6 as desired.

Payment means 12 comprises any mechanism adapted to receive, for example, game tokens or arcade-type cards, credit cards or cash. A payment made entitles one or more players to commensurate use of the system. Payments may entitle the player(s) to a predetermined playing time, as measured by a timer 9 in control mechanism or computer 10, a predetermined number of balls to be delivered by ball feeder 8, or other means for limiting play (such as described below.) The term computer, as used herein, is understood to mean a generic device including a microprocessor and input/output means in electrical communication with the various system components so as to enable control over the system components configured in a particular system. In certain embodiments of the present invention, simpler mechanisms known in the art for controlling usage, for example, of batting or soccer cages may be similarly employed for limiting usage of the system.

Court 4 is preferably, though not necessarily, comprised of a flat, resilient surface, such as a basketball parquet, that will support players running and dribbling on it, and one or more co-planar deformable elastic surfaces, such as trampolines 16, each of which is lined with padding 18. The trampoline(s) 16 may have any variety of shapes, such as squares, rectangles, triangles, circles, ellipsoids, trapezoids, hexagons, and octagons. They are preferably arranged so as to enable players to bounce on them as they attempt to slam balls through the hoop. In one embodiment, their arrangement is similar to that of courts used in the popular SLAMBALL™ game. Because the trampolines require a region below the planar surface into which they may deform, the court is either elevated, or alternatively below each trampoline there exists a below-ground pit.

Figure 2A:
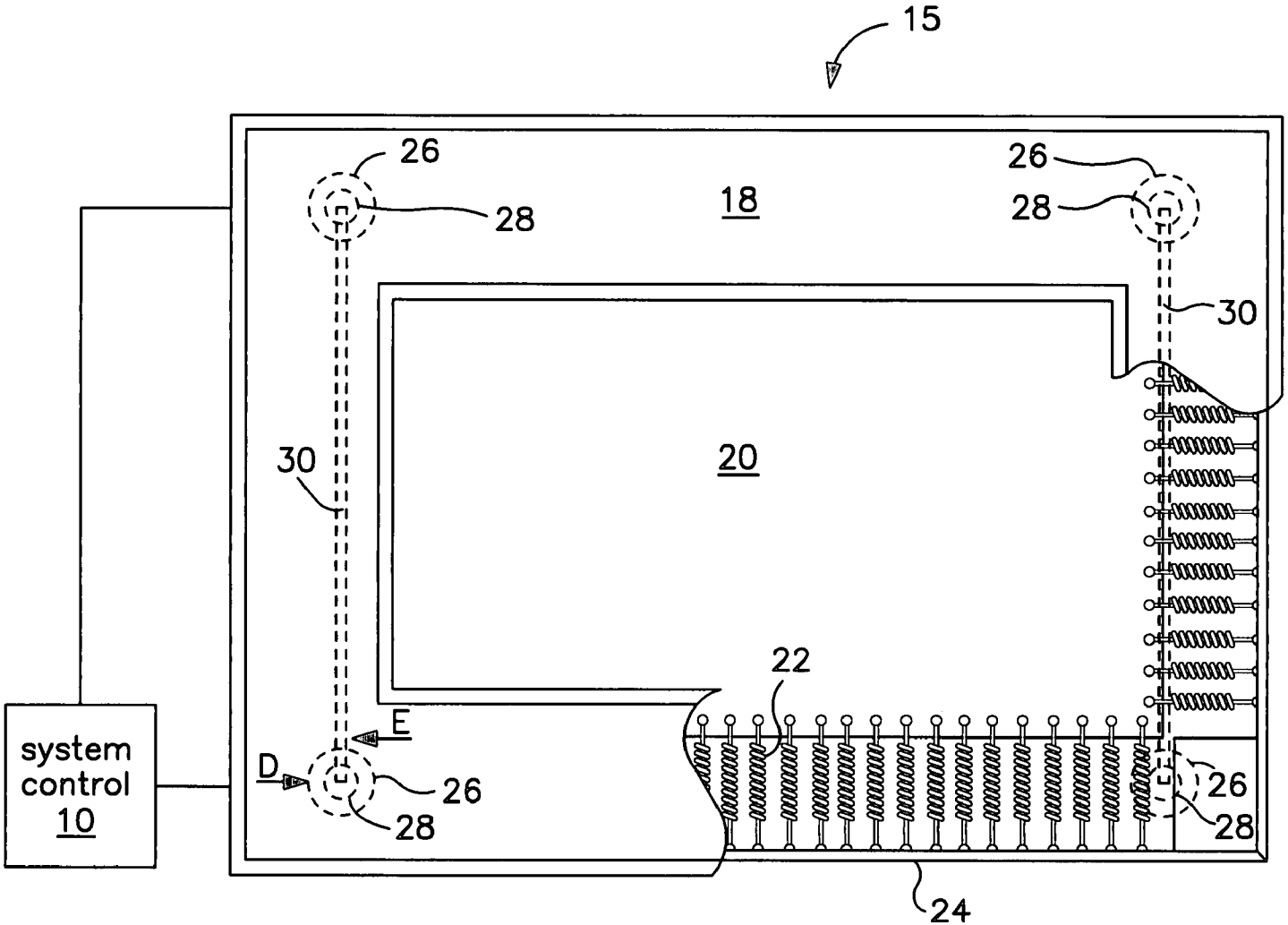
FIGS. 2A,B are schematic illustrations of trampolines and a hydraulic piston elasticity control means.

With reference to FIG. 2A, the trampolines 16 are of a construction consistent with the known state of the art (see U.S. Pat Nos. 4,119,311, 5,007,638 and 6,135,922), such as embodied wherein a section of sturdy, flexible membrane 20 (such as a fabric) to which are fastened about the perimeter of the membrane an array of coil springs 22. The other ends of the springs 22 are connected to a rigid, immovable surface 24. When a player bounces on the trampoline, the springs 22 are stretched. Their return to their normal length provides a resistive counter-force causing the membrane to propel the player vertically. Some commercially available trampolines, such as the JUMPSPORT Model 1240 with Soft-Bounce™ system, may serve as the basis for the trampolines 16 construction. An additional feature not available in the prior art is the ability to control the elasticity provided by the trampoline. This is useful in alternative embodiments of the system 2, wherein the ability to adjust or limit the elasticity is used to increase or decrease the difficulty of the game or practice session for the player(s), or it may be used as means to limit player usage of system 2 (i.e., by completely eliminating the elasticity provided by the trampolines.) Obviously, adjusting the elasticity should be accomplished gradually to minimize potential player injury.

Figure 2B:
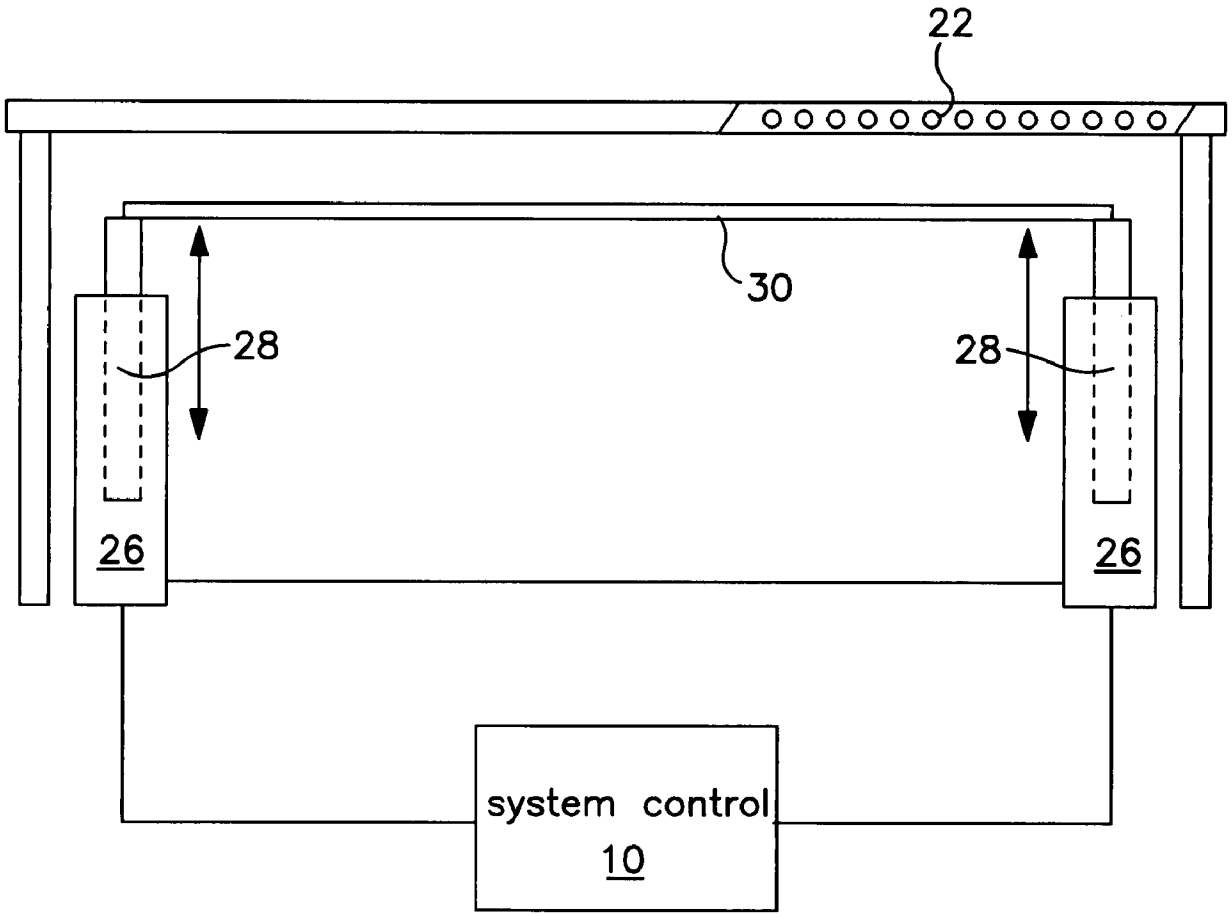

FIGS. 2A and 2B illustrate one elasticity adjustment means, wherein a stop bar 30 is vertically raised to engage, or constrain the motion and/or extension of, the springs by one or more hydraulic pistons 28. Control over the operation of the pistons 28 is accomplished by computer 10.

Figure 3:
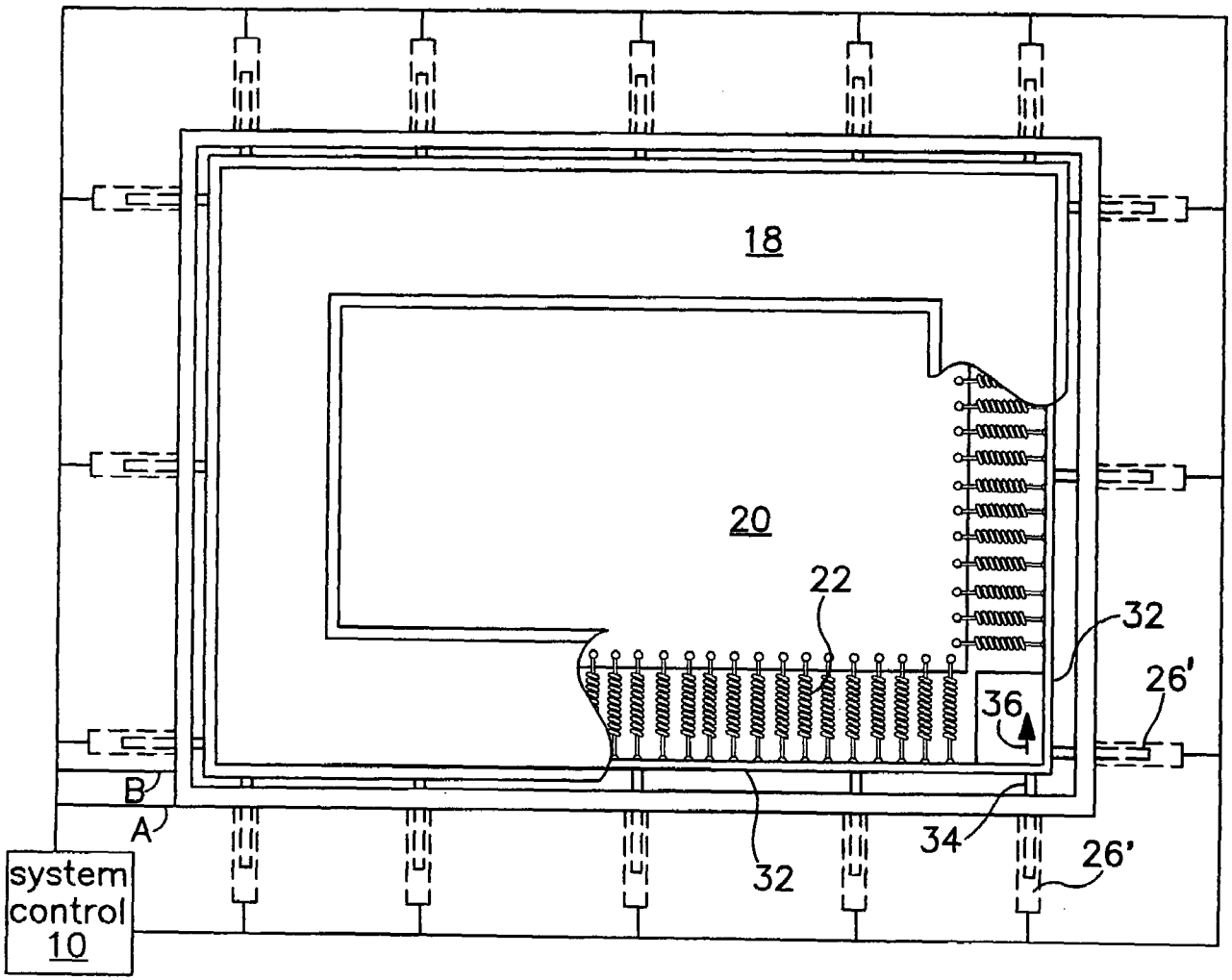
FIG. 3 is alternative configuration of the hydraulic piston elasticity control means.

FIG. 3 illustrates an alternative configuration of the elasticity control means. In this configuration, hydraulic pistons 26' are horizontally disposed with respect to the trampoline material 20 and springs 22. Here, each of the springs 22 are connected to the material 20 on one end, and the other end of each spring is connected to a inflexible surface 32 that, in turn is connected to the horizontally-disposed hydraulic pistons 26'. In normal operation, hydraulic pistons 26', while contacting surface 32, exert no displacing force on the surface 32. Thus, surface 32 is unmoving and a constant repulsive force is provided by the springs. When adjustment to decrease the elasticity of the trampoline is desired, the piston rod 34 is extended to displace surface 32 (for example, from position A to position B, in the direction of arrow 36) such that the springs 22 will not be extended to the same degree as they would be had surface 32 not been displaced. This has the effect, in turn, of reducing the reflexive, elastic force provided by the trampoline to a player jumping thereupon.

Other means for controlling the elasticity of the trampolines 16 are also possible. One alternative (not shown) consists of pressurizing a closed region, or locating inflatable reservoirs, below the material 20 of the trampoline to a pressure that provides a sufficient resistance to the deformation of the elastic surface allowed by the springs 22. A controllable pump and discharge valve for each trampoline is required for such an embodiment.

With reference again to FIG. 1A, ball feeder 8 delivers the balls to players on the court through ejector port 38. Various forms of ball propulsion are employed in alternative embodiments, including, for example, catapults, pneumatic blowers and spinning wheels, etc. U.S. Pat. Nos. 5,310,176, 5,364,091, 5,776,018, 5,980,391, 5,681,043, 4,699,386, 5,769,064, 4,013,292, 4,714,248, 4,678,189, 4,579,340, 3,777,655 and 6,280,352 present various ball feeding technology that can be adapted for use in system 2. (To the extent necessary, the teachings of these references are incorporated by reference.) The ball delivery speed and trajectory can be controlled either by computer 10 or by the players themselves through adjustment of ball feeder 8 controls proximate the players. In a preferred embodiment, the balls that pass through the hoop 6 are captured by a ball collector 42 for conveyance back to the ball feeder 8, where they are received at ball input port 40. A plurality of balls are preferably employed in order to effect rapid play or practice, with extra balls stored in reserve within ball feeder 8. In certain multi-court arrangements of the system (described below), a single ball feeder 8 equipped with multiple ball collectors 42 and input ports 40 may serve a corresponding multitude of courts. In a preferred embodiment, the ball collector 42 consists of a tubular section of netting of sufficient dimensions to convey a basketball or similarly-sized ball to the input port 40 that is attached or proximate to the bottom of the hoop 6. The ball feeder 8 may include a counter 48 that keeps track of the number of balls either returning through the input port 40 (or, is positioned proximate the hoop 6, balls passing therethrough) and/or delivered through the ejector port 38. This information is then output to computer 10, where it is used in computing player metrics or determining whether the predetermined system usage paid for by the player(s) has been met. The ball feeder 8 can be set at any speed, direction, and angle to simulate a basketball pass. If the participant successfully slams the ball through the hoop 6, ball collector 42 captures the ball for conveyance to the ball feeder. If the participant misses and does not successfully slams the ball into the basket, the participant is allowed to retrieve the ball and try again. Only upon a successful attempt will a new ball be released to the participant.

Figure 4:
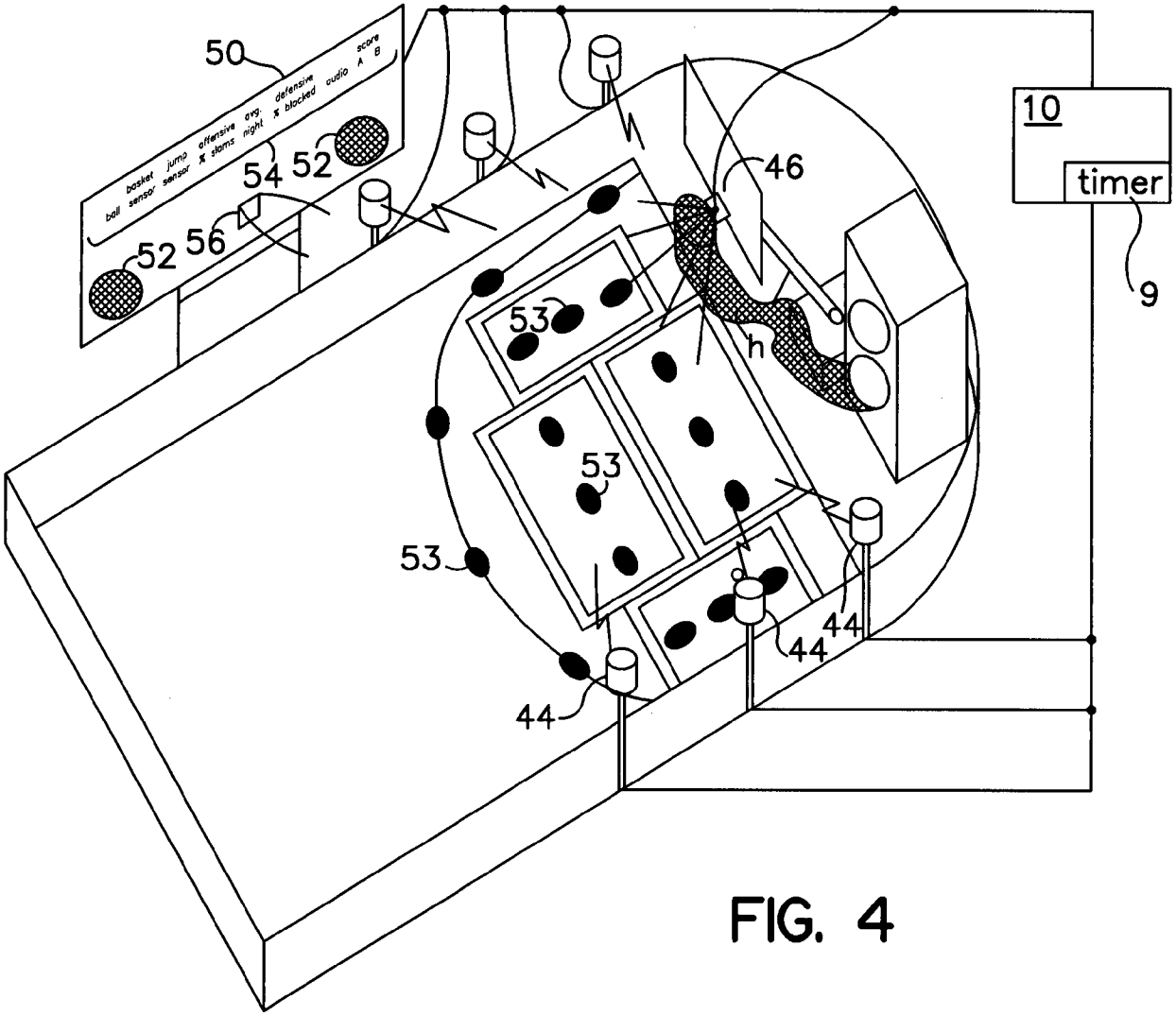
FIG. 4 is a schematic illustration of a system embodiment illustrating various sensors and visual and audio output means.

In a preferred embodiment illustrated in FIG. 4, system 2 is configured with a plurality of sensors 44,46 providing output signals to computer 10 that comprise position and/or trajectory information related to the players and balls on the court. The following U.S. patents are instructive as to the technology that may be adapted to provide the functionality required of sensors 44,46 and computer 10: U.S. Pat. Nos. 5,423,554, 5,138,322, 5,064,195, 6,280,352, 6,539,336, 5,372,365 6,389,368, 6,095,928, 5,684,453, 5,537,212, and 5,684,453. (To the extent necessary, the teachings of these references are incorporated by reference.) These references describe sensing systems employing cameras, lasers, radiofrequency and ultrasound energies. Other sensing systems may be employed, provided the sensors (alone or various combinations of sensor types) have the ability to differentiate between players, on the same team or competing teams, and track the players (and ball) in three dimensions in order to capture information related to vertical heights jumped from the court, "hang times", successful ball shots, dunks or slams, and similarly blocked shots or slams. Player differentiation in some of these sensor systems is achieved by player equipment or clothing, for example, red versus blue jerseys, or remotely sensable radiation-emitting tags (e.g. RF identification.) The sensor 46 disposed at the hoop 6 may be employed instead of ball counter 48 to keep track of the number of balls shot, dunked or slammed.

Computer 10 uses the position and trajectory information output from the sensors 44,46 to compute various player and/or team metrics, and/or to create a visual or audio output relative to the computed metrics. FIG. 4 shows a scoreboard 50 upon which said metrics 54 are displayed. Player and team metrics consist of, among other indications, vertical height(s) jumped, numbers of jumps, average jump heights, hang times, consecutive made shots, number of successful slams, overall team and individual scores, distance from the hoop, the hoop angle, percentages of successful slams, and percentages of successful blocks. Other such measures of player performance are possible, and the metrics may also be presented in terms of particular time periods (e.g., successful slams per minute), or in the context of other adjustable system parameters (e.g., successful slams at a particular hoop height or trampoline elasticity, etc.)

Simpler alternatives to the three dimensional player-tracking sensing system can also be employed. For example, a simple ball counter or an electronic eye or sensor attached to the rim and or backboard can keep track of the number of successful and failed attempts and will capture such information which will then be transmitted to a computer controlled audio and scoring metric system.

Also illustrated is a pair of speakers 52 shown as embedded in scoreboard 50, but they are not required to be. The audio output that computer 10 causes speakers 52 to create is preferably responsive to the measured performance of the player(s) on the court. For example, speakers 52 may simulate crowd jeers and/or cheers in response to a made shot or slam. Alternatively, when system 2 is being operated in Training Mode, as opposed to Play Mode, the audio output may include training instruction individualized to a particular player based on his or her motions as detected by the sensors 44,46. Optionally, a camera 56 may record for the player(s) or coach(es) the action that occurs on the court. In a commercial pay-to-play environment, the camera may capture still photos or short movies on video tape of a game or practice session for sale to a user of the system.

The automated ball feeder (and collector), means for adjusting the hoop and/or backboard position, payment receiving means, and elasticity control means and sensing system features are not mutually exclusive; system 2 may be configured with each feature individually or in various combinations.

Figure 5A:
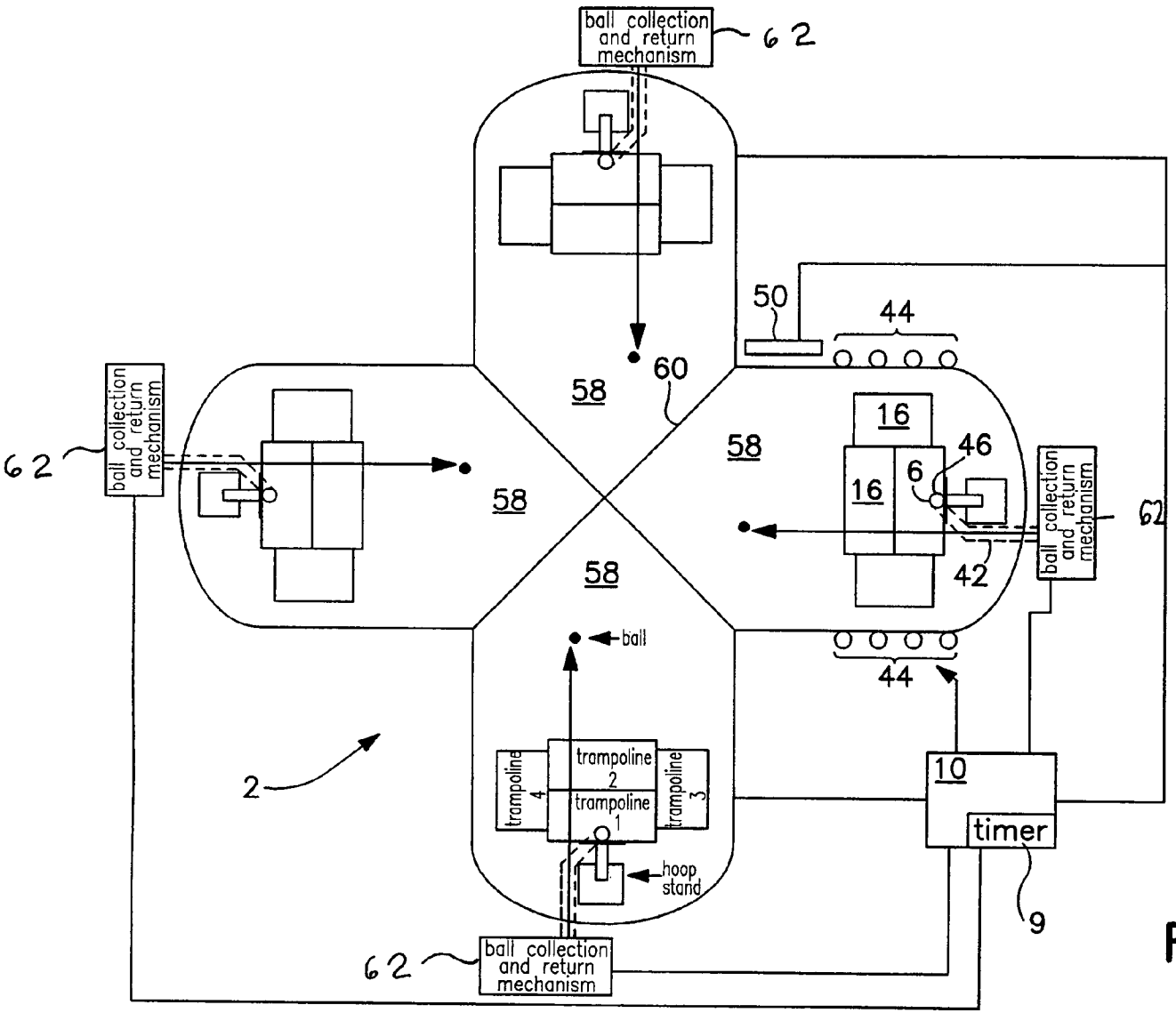
FIGS. 5A,B are schematic illustrations of multi-court embodiments of the system.
Figure 5B:
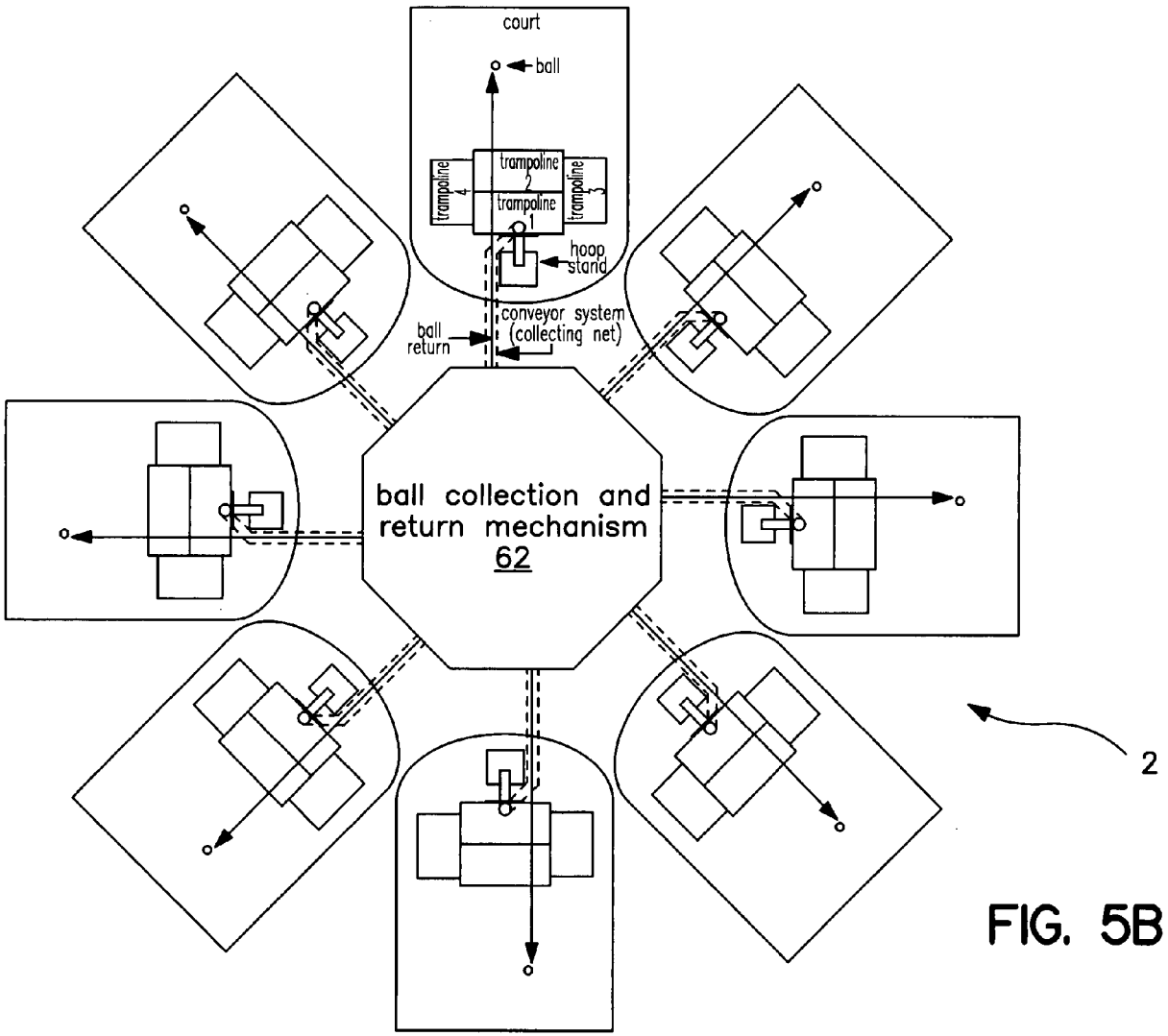

With reference to FIGS. 5A–B, the system 2 can alternatively be arranged in a multi-court configurations. In FIG. 5A, each court is part of a single continuous planar playing surface that is sectioned into multiple playing areas 58 by one or more vertical partitions 60. Each playing area 58 includes some or all of the automated features described above (although for clarity purposes they are displayed in detail for only one playing area.) In the multi-court embodiment, groups of players on one court may "play against" groups of players on different courts by comparing their relative metrics. The partition 60 may be a net or wall preventing balls and players from traversing into other courts. A partition is not required for some games—for example, a "full court" game of basketball or SLAMBALL™ requires that there be no physical boundary between two opposed courts. FIG. 5B illustrates an alternative multi-court configuration of system 2, wherein each of the multiple courts share a common ball collection and feeder mechanism 62. Ball collection and feeder mechanism 62 allows independent, simultaneous play and/or practice on each of the courts.

As noted above, the system 2 may be used in multiple modes: Training (individual or team), and Playing (single or multiple courts, single or multiple players on each court.) The particular mode selected will determine what metrics are displayed on the scoreboards associated with the court(s) being used. Each use of the system, however, is preceded by the receipt of a payment from those desiring system usage. System computer 10 will then prompt the participants for answers to questions in order to select options and settings for the courts (e.g., hoop height, elasticity, etc.) As discussed, players may be required to wear some article that allows the system sensors (if selected for use) to detect and differentiate the players from each other. Various offensive and defensive metrics can then be more easily measured and maintained.

The system response for a single player practice session is represented in Table One, which reflects the visual (scoreboard 50 display) and audio (speaker 52 ) outputs created by the system computer 10 in response to the metrics reflected.

TABLE ONE

| Ball | Basket Sensor | Jump Sensor | % SLAMS | AVG HT. | Basket Height | Audio Sound |
|---|---|---|---|---|---|---|
| 1 | 1 attempt | 1 foot | 1 of 1–100 | 1 foot | 8 ft. | Cheer |
| 2 | 2 attempts | 1 foot, 1.5 | 2 of 3–66.6 | 1.16 ft | 7 ft. | Booh |
| 3 | 1 attempt | 1.5 feet | 3 of 4–75 | 1.25 ft | 8 ft. | Cheer |
| 4 | 1 attempt | 1.75 feet | 4 of 5–80 | 1.35 ft | 7 ft. | Clap |
| 5 | 2 attempts | .5 foot, 1 ft | 5 of 7–71.4 | 1.18 ft | 7 ft. | Booh |
| 6 | 3 attempts | 0.5, 1, 1.5 ft | 6 of 10–60 | 1.125 ft | 7 ft. | Loud Booh |

TABLE ONE-continued

| Ball | Basket Sensor | Jump Sensor | % SLAMS | AVG HT. | Basket Height | Audio Sound |
|---|---|---|---|---|---|---|
| 7 | 1 attempt | 1.5 feet | 7 of 11–63.6 | 1.16 ft | 9 ft. | Cheer |
| 8 | 1 attempt | 1.75 feet | 8 of 12–66.6 | 1.21 ft | 9 ft. | Cheer |
| 9 | 1 attempt | 2 feet | 9 of 13–69.2 | 1.27 ft | 9 ft. | Cheer & Clap |
| 10 | 1 attempt | 2 feet | 10 of 14–71.4 | 1.32 ft | 9 ft. | Cheer & Clap |

The system response for a team (one offensive, one defensive player) training session is represented in Table Two:

TABLE TWO

| Ball | Basket Sensor | Jump Sensor | OFFENSIVE % SLAMS | AVG. HT. | DEFENSIVE % BLOCKED |
|---|---|---|---|---|---|
| 1 | 1 attempt | 1 foot | 1 of 1–100 | 1 foot | 0 |
| 2 | 2 attempts | 1, 1.5 ft. | 2 of 3–66.6 | 1.16 ft | 33.3 |
| 3 | 1 attempt | 1.5 feet | 3 of 4–75 | 1.25 ft | 25 |
| 4 | 1 attempt | 1.75 feet | 4 of 5–80 | 1.35 ft | 20 |
| 5 | 2 attempts | .5, 1 foot | 5 of 7–71.4 | 1.18 ft | 28.6 |
| 6 | 3 attempts | .5, 1, 1.5 ft | 6 of 10–60 | 1.125 ft | 40 |
| 7 | 1 attempt | 1.5 feet | 7 of 11–63.6 | 1.16 ft | 36.4 |
| 8 | 1 attempt | 1.75 feet | 8 of 12–66.6 | 1.21 ft | 33.3 |
| 9 | 1 attempt | 2 feet | 9 of 13–69.2 | 1.27 ft | 30.8 |
| 10 | 1 attempt | 2 feet | 10 out 14–71.4 | 1.32 ft | 28.6 |

It can be readily appreciated how these examples can be extended for the purposes of multi-court practice and play, with multiple players and teams on each of the courts.

Although the invention has been described with respect to various embodiments, it should be realized this invention is also capable of a wide variety of further and other embodiments within the spirit of the invention.

I claim:

1. A ball game system, comprising:

a planar playing surface including a surface adjacent one or more deformable elastic surfaces;

a hoop dimensioned to receive a ball and disposed at an elevated position proximate an end of the playing surface;

means for adjusting or limiting the elasticity of rebounds provided by the one or more deformable elastic surfaces;

means for receiving a payment and providing a signal indicative of a payment being made;

means operably connected to the elasticity adjusting or limiting means for controlling the elasticity adjusting or limiting means in response to the signal from the payment receiving means so as to restrict or enable player use of the one or more deformable elastic surfaces;

the one or more of deformable elastic surfaces comprise trampolines, each including a flexible fabric to which is connected about a perimeter of the flexible fabric a plurality of biasing members providing elastic forces resisting deformation of the flexible fabric; and the elasticity adjusting or limiting means comprises an inflexible member which is operably connected to the plurality of biasing members to constrain the motion and/or extension of the plurality of biasing members; and at least one movable piston connected to the inflexible member to move the inflexible member to a position so as to oppose the resistive forces provided by the plurality of biasing members, the at least one movable piston being controlled by the control means.

2. The ball game system of claim 1, wherein the payment is made by one of the following means: tokens, credits, cash, credit cards and arcade-type cards.

3. The ball game system of claim 1, wherein the payment entitles a player to a predetermined playing time.

4. The ball game system of claim 1, further comprising padding disposed about the perimeter of each of the one or more deformable elastic surfaces.

5. The ball game system of claim 1, wherein the deformable elastic surfaces have shapes selected from the group consisting of squares, rectangles, triangles, circles, ellipsoids, trapezoids, hexagons, and octagons.

6. The ball game system of claim 1, wherein the elasticity adjusting or limiting means further comprises:

one or more pressurizable chambers disposed below each of the deformable elastic surfaces;

pumping means for adjustably pressurizing the chambers to a pressure such that the deformation of the deformable elastic surfaces is resisted; and pressure releasing means for adjustably returning the one or more chambers to atmospheric pressure.

7. The ball game system of claim 1, further comprising:

a ball feeder for delivering a ball to a point above the planar playing surface, the delivery controlled by the control means in response to the payment received; and a ball collector for conveying balls passing through the hoop to the ball feeder.

8. The ball game system of claim 7, wherein the ball collector comprises netting disposed circumferentially below the hoop and forming a channel of sufficient diameter to accommodate the balls passing through the hoop.

9. The ball game system of claim 7, wherein the ball feeder allows selection of ball delivery speed.

10. The ball game system of claim 7, wherein the ball feeder allows selection of ball delivery along a trajectory above the playing surface.

11. The ball game system of claim 7, wherein the ball feeder includes a ball counter outputting to the control means the number of balls delivered.

12. The ball game system of claim 7, wherein the payment entitles a player to a predetermined number of balls delivered from the ball feeder.

13. The ball game system of claim 1, further comprising a plurality of sensors outputting to the control means position and trajectory information related to one or more moving players and ball above the planar surface; and wherein the control means creates an output responsive to the movement of the one or more players and ball.

14. The ball game system of claim 13, wherein one or more of the plurality of sensors outputs player differentiation information.

15. The ball game system of claim 13, wherein the position and trajectory information includes a vertical height measured from the planar surface to a player jumping from the planar surface.

16. The ball game system of claim 13, further comprising a scoring sensor outputting an indicator to the control means that a ball has passed through the hoop.

17. The ball game system of claim 13, wherein the sensors output information related to blocked attempts to place the ball through the hoop.

18. The ball game system of claim 13, wherein the output comprises a visual display of player metrics.

19. The ball game system of claim 18, wherein the metrics consist of one or more metrics selected from the group consisting of: height jumped, number of jumps, average jump height, hang time, number of successful slams, distance from hoop, hoop angle, score, percentage successful slams, percentage successful blocks, and average number of successful slams in per time unit.

20. The ball game system of claim 18, wherein the player metrics are presented in relation to a specified time period.

21. The ball game system of claim 18, wherein the player metrics are presented in relation to a particular deformable elastic surface elasticity.

22. The ball game system of claim 13, wherein the output comprises sounds responsive to the measured performance of the one or more players.

23. The ball game system of claim 20, wherein the sounds comprise simulated crowd noises.

24. The ball game system of claim 20, wherein the sounds comprise training instructions.

25. The ball game system of claim 13, wherein the control means output represents a comparison of the respective performance of one or more players on the planar surface to the respective performance of one or more different players, as indicated by the position and trajectory information measured by the plurality of sensors.

26. The ball game system of claim 1, further comprising a camera controlled by the control means for recording activity occurring on the playing surface.

27. The ball game system of claim 1, wherein the hoop position is adjustable from a horizontal position permitting use to a more vertical position restricting use of the hoop in response to the payment received.

28. The ball game system of claim 1, wherein the backboard position is adjustable.

29. The ball game system of claim 1, wherein the plurality of biasing members are substantially horizontal and the at least one movable piston is substantially vertical with respect to the substantially horizontal plurality of biasing members.

30. The ball game system of claim 1, wherein the plurality of biasing members are substantially horizontal and the at least one movable piston is also substantially horizontal.

31. The ball game system of claim 1, wherein the surface adjacent one or more deformable elastic surfaces is resilient.

32. The ball game system of claim 1, wherein at least one of the plurality of the biasing members is a spring.

* * * * *